US007937014B2

(12) United States Patent
Kawamata

(10) Patent No.: US 7,937,014 B2
(45) Date of Patent: May 3, 2011

(54) IMAGE FORMING APPARATUS WITH COOLING FAN FOR COOLING IMAGE HOLDING MEMBERS

(75) Inventor: Kunimasa Kawamata, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1145 days.

(21) Appl. No.: 11/636,514

(22) Filed: Dec. 11, 2006

(65) Prior Publication Data

US 2007/0268321 A1 Nov. 22, 2007

(30) Foreign Application Priority Data

May 19, 2006 (JP) ..... 2006-140464

(51) Int. Cl.
*G03G 21/20* (2006.01)

(52) U.S. Cl. ..... 399/92; 399/94; 399/110; 399/91

(58) Field of Classification Search ..... 399/92, 399/124, 125, 302, 313, 308, 312, 400, 110, 399/121, 93, 94, 31, 96; 415/170.1, 173.3, 415/174.2

See application file for complete search history.

(56) References Cited

U.S. PATENT DOCUMENTS

| | | | | |
|---|---|---|---|---|
| 5,179,412 | A | 1/1993 | Yamada et al. | |
| 6,505,018 | B2 * | 1/2003 | Fukutome | 399/92 |
| 7,400,842 | B2 * | 7/2008 | Takehara et al. | 399/92 |
| 7,433,624 | B2 * | 10/2008 | Ohkura | 399/92 |
| 2002/0054770 | A1 | 5/2002 | Kimizuka | |
| 2002/0085849 | A1 * | 7/2002 | Endo | 399/49 |
| 2004/0234301 | A1 * | 11/2004 | Sato et al. | 399/299 |
| 2006/0083543 | A1 * | 4/2006 | Sunohara | 399/110 |

FOREIGN PATENT DOCUMENTS

| | | | |
|---|---|---|---|
| JP | 58-200251 | * | 11/1983 |
| JP | 2003-270906 | * | 9/2003 |
| JP | 2003-345197 | * | 12/2003 |
| JP | 2004-184450 A | | 7/2004 |
| JP | 2005-241934 | * | 9/2005 |
| JP | 2005-241934 A | | 9/2005 |
| JP | 2005-283733 A | | 10/2005 |
| JP | 2006-058528 | * | 3/2006 |

* cited by examiner

*Primary Examiner* — David P Porta
*Assistant Examiner* — Yara B Green
(74) *Attorney, Agent, or Firm* — Sughrue Mion, PLLC

(57) ABSTRACT

An image forming apparatus includes plural image holding members that hold toner images, a belt unit, an apparatus side portion, and a fan unit. The belt unit includes a belt member disposed facing the plural image holding members. The apparatus side portion is disposed on an outer side of the belt unit in an axial direction of rotating shafts of the plural image holding members. The fan unit is disposed between the apparatus side portion and the belt unit and aerates end portions of the belt unit in the axial direction of the rotating shafts.

19 Claims, 13 Drawing Sheets

IMAGE FORMING APPARATUS WITH COOLING FAN FOR COOLING IMAGE HOLDING MEMBERS

BACKGROUND

1. Technical Field

The present invention relates to an image forming apparatus.

2. Related Art

In recent years, in accompaniment with the spread of electrophotographic color image forming apparatus, demands with respect to increasing the speed of color output have risen in addition to demands with respect to the printing quality of color images, and several image forming systems have been proposed in order to meet these demands. Among these, a configuration called tandem system is known. Among tandem system color image forming apparatus, there is a configuration where toner images of the respective colors of black, cyan, magenta, and yellow are formed on photoreceptor drums of these respective colors and the toner images are sequentially transferred to and superposed on recording paper conveyed by a transfer belt to form a full-color toner image on the recording paper.

Within a tandem system color image forming apparatus of this configuration, the temperatures of the plural photoreceptor drums increase and these temperature increases become synergistic, so that it becomes easy for the temperature inside the apparatus to rise particularly in an apparatus that is made compact by shortening the distances between the photoreceptor drums. Further, when two-sided printing is continuously performed, one side of the recording paper is printed and the recording paper passes through a fixing device whose temperature is high, and the recording paper again passes through the image forming section in a state where the recording paper is hot, which leads to an increase in the temperature inside the apparatus.

Because of such circumstances, it has been necessary to design tandem system color image forming apparatus such that the increase in temperature inside the apparatus body is sufficiently taken into consideration. Cooling the photoreceptor drums and the development section in particular has been important.

SUMMARY

In consideration of the above circumstances, the present invention provides an image forming apparatus.

According to an aspect of the invention, there is provided an image forming apparatus comprising: a plurality of image holding members that hold toner images; a belt unit that comprises a belt member disposed facing the plurality of image holding members; an apparatus side portion that is disposed on an outer side of the belt unit in an axial direction of rotating shafts of the plurality of image holding members; and a fan unit that is disposed between the apparatus side portion and the belt unit and aerates end portions of the belt unit in the axial direction of the rotating shafts.

BRIEF DESCRIPTION OF THE DRAWINGS

An exemplary embodiment of the present invention will be described in detail based on the following figures, wherein.

DETAILED DESCRIPTION

Figure 1:
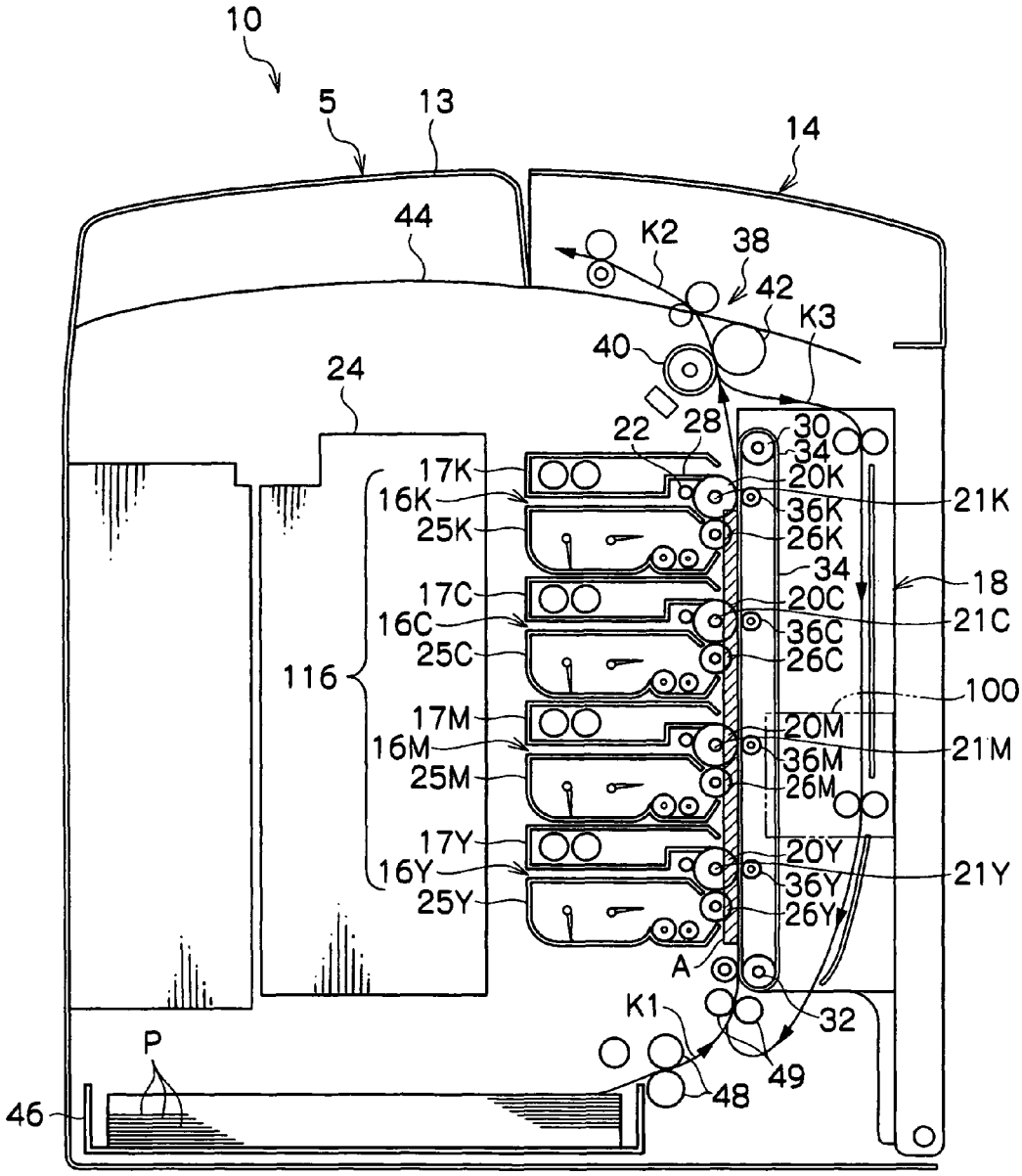
FIG. 1 is a general side view showing the configuration of an image forming apparatus pertaining to the exemplary embodiment of the present invention.

An exemplary embodiment of the present invention will be described below. In the drawings, the letters Y, M, C, and K are added after reference numerals representing members disposed for the colors of yellow (Y), magenta (M), cyan (C), and black (K). However, when it is not necessary to distinguish between these colors, the letters Y, M, C, and K will be omitted.

First, an overview of an image forming apparatus 10 will be described.

As shown in FIG. 1, the image forming apparatus 10 includes process units 16Y to 16K lined in a vertical direction. The process units 16Y to 16K of the respective colors include photoreceptor drums 20Y to 20K as image holding members. The photoreceptor drums 20Y to 20K are also lined in the vertical direction. Hereinafter, when simply "outer side" and "inner side" are mentioned, this will mean inside and outside with respect to the axial direction of rotating shafts 21 of the photoreceptor drums 20. Further, the axial direction of the rotating shafts 21 of the photoreceptor drums 20 is the width direction of the apparatus. Moreover, in FIG. 1, the right side is the front side of the apparatus and the left side is the deep side (rear side) of the apparatus.

Figure 2:
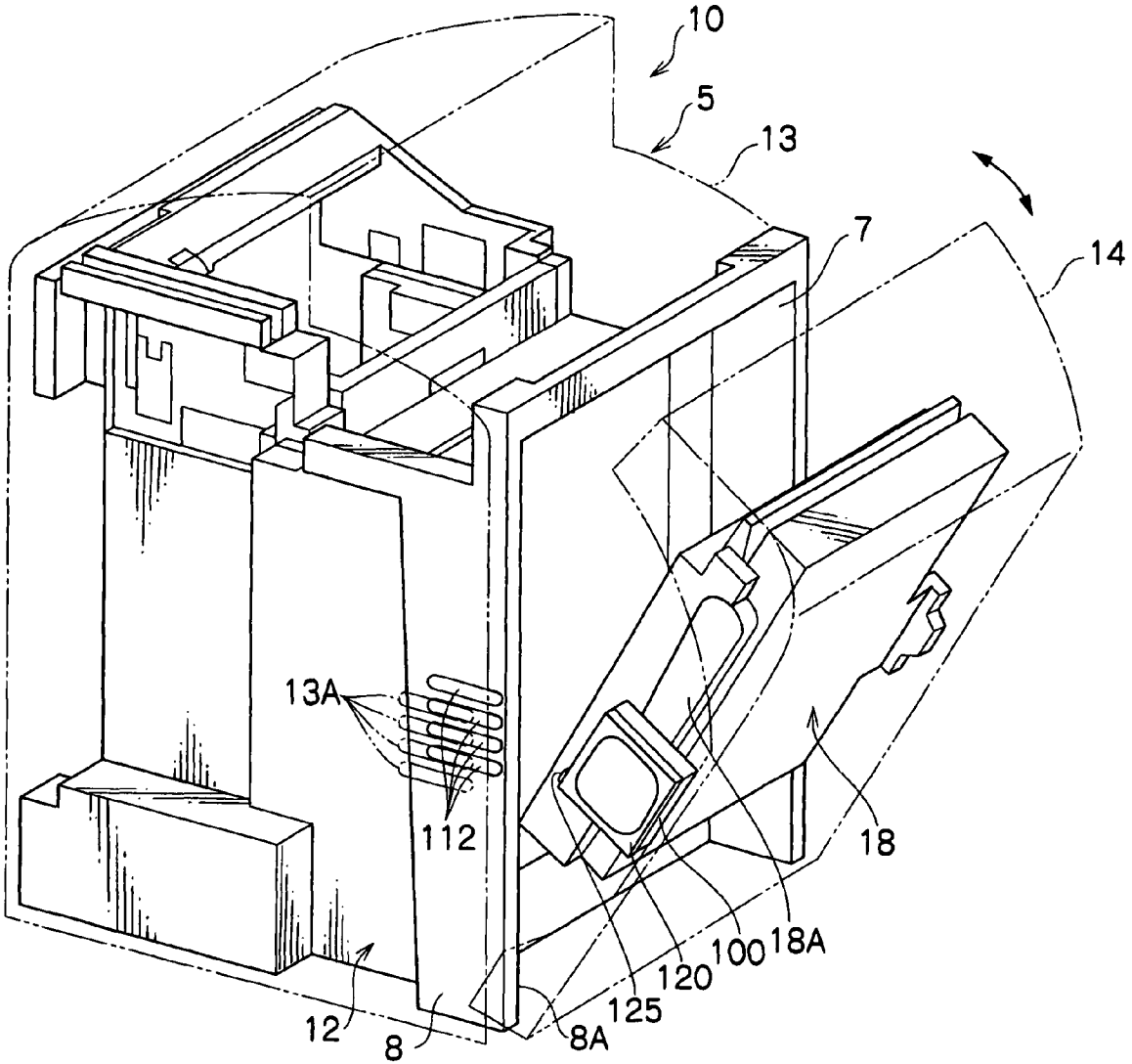
FIG. 2 is a perspective view showing a state where an open/close cover of the image forming apparatus pertaining to the exemplary embodiment of the present invention is open.
Figure 3:
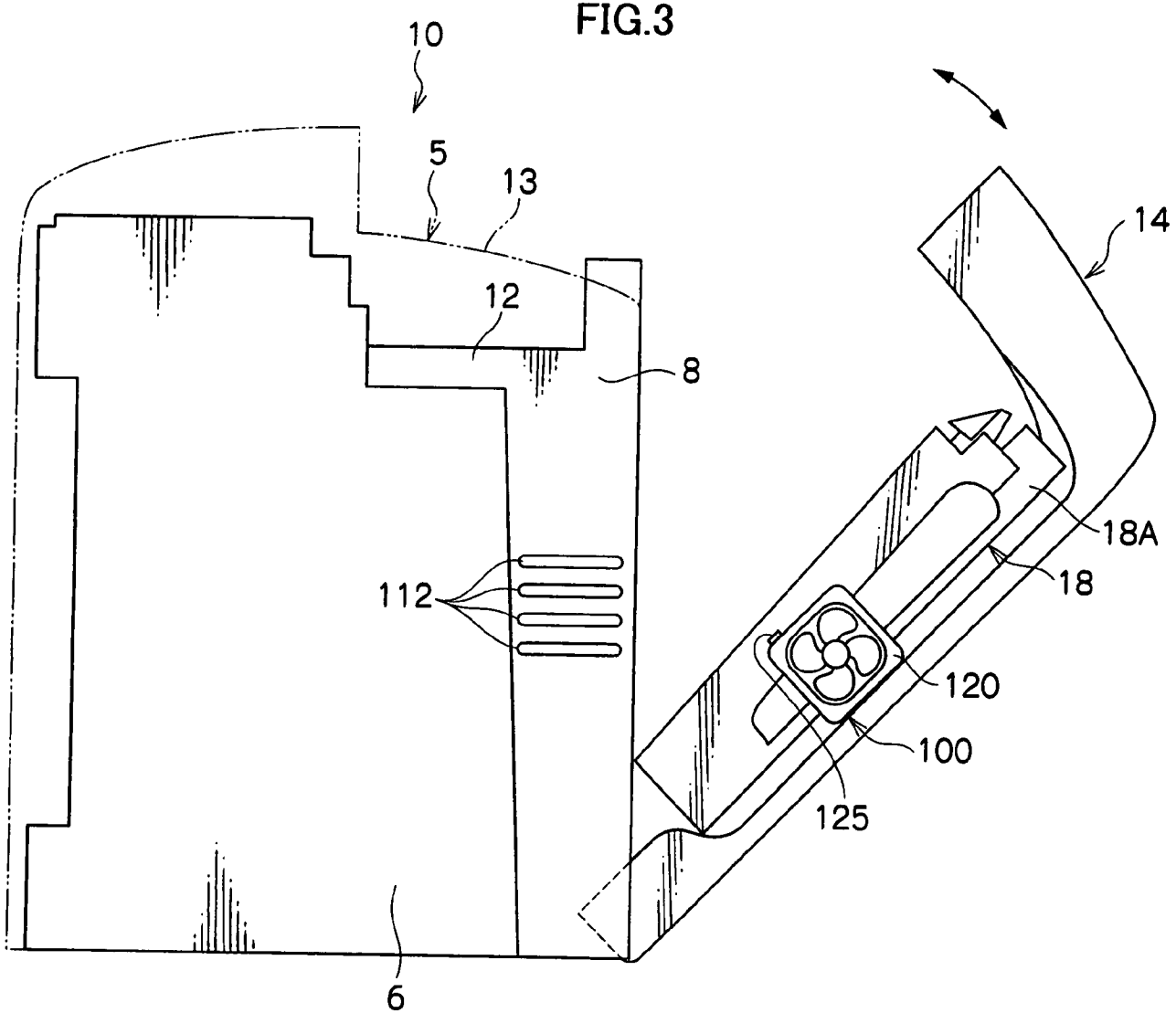
FIG. 3 is a side view showing a state where the open/close cover of the image forming apparatus pertaining to the exemplary embodiment of the present invention is open.

As shown in FIG. 2 and FIG. 3, the image forming apparatus 10 is configured by an apparatus body 5 and an open/close cover 14. A conveyance unit 18 (see also FIG. 12) disposed with a conveyor belt 34 that is capable of attracting and conveying recording paper P is attached to the open/close cover 14. By opening and closing the open/close cover 14, the process units 16 (the photoreceptor drums 20) may be opened up and closed off to perform various kinds of work such as maintenance and removing jammed paper.

The apparatus body 5 includes a body frame 12 (see also FIG. 4) that houses the process units 16, and a casing cover 13 (see FIG. 2 and FIG. 7) covers the outer side of the body frame 12.

As shown in FIG. 1, the process units 16 include charge rollers 22 that uniformly charge the surfaces of the photoreceptor drums 20. The process units 16 also include development units 25 that selectively spread toners onto latent images formed on the photoreceptor drums 20 by laser light emitted from a light scanning device 24, so that the latent images are made visible. The process units 16 further include cleaning units 17 that include cleaning members 28 that clean residual toner remaining on the photoreceptor drums 20 after the toner images have been transferred onto the recording paper P.

The development units 25 house the toners inside and include development rollers 26. The development rollers 26 are disposed in proximity to and facing the photoreceptor drums 20, and development bias voltages are applied to the development rollers 26. Thus, development bias electric fields are formed between the development rollers 26 and the photoreceptor drums 20, and the toners held on the development rollers 26 spread to the exposed electrostatic latent images on the photoreceptor drums 20 to form the toner images.

The conveyance unit 18 (see also FIG. 12) includes the conveyor belt 34, which is stretched around a drive roller 30 and a driven roller 32. Four transfer rollers 36Y to 36K are disposed in correspondence to the respective colors at predetermined positions between the drive roller 30 and the driven roller 32 at the inner surface side of the conveyor belt 34.

The transfer rollers 36 are configured to face the photoreceptor drums 20, with the conveyor belt 34 being sandwiched therebetween, when the open/close cover 14 is closed (when the open/close cover 14 is rotated toward the body frame 12 to close off the photoreceptor drums 20 and the like). The transfer rollers 36 form transfer electric fields between themselves and the photoreceptor drums 20 and sequentially transfer and superpose, onto the passing recording paper P attracted to and conveyed by the conveyor belt 34, the toner images of the respective colors present on the photoreceptor drums 20Y to 20K of the respective colors to form a full-color toner image (unfixed full-color toner image) on the recording paper P.

A fixing device 38 is disposed downstream (in the upper portion of the image forming apparatus 10) of the process units 16Y to 16K in the conveyance direction of the recording paper P. The recording paper P sent from the conveyance unit 18 is conveyed along an ejection path K2 and is sent to the fixing device 38.

The fixing device 38 includes a heat roller 40 and a pressure roller 42 whose peripheral surfaces face each other and are pressed together (to form a nip) with predetermined pressure. The unfixed full-color toner image that has been transferred onto the recording paper P is heated and pressured by the heat roller 40 and the pressure roller 42 such that the full-color toner image is fixed to the recording paper P. The recording paper P to which the full-color toner image has been fixed by the fixing device 38 is ejected into a exit tray 44.

A paper feed cassette 46 in which the recording paper P is accommodated is disposed in a lower portion of the image forming apparatus 10. A paper feed roller pair 48 that feeds the recording paper P one sheet at a time from the paper feed cassette 46 is disposed in the vicinity of the front end portion of the paper feed cassette 46, and the recording paper P fed from the paper feed roller pair 48 is conveyed along a conveyance path K1, fed at a predetermined timing by a registration roller pair 49 to an attracting/conveying surface of the conveyor belt 34, and conveyed to transfer positions of the toner images of the respective colors.

The transfer rollers 36Y to 36K and the conveyor belt 34 that is capable of electrostatically attracting the recording paper P are disposed in the conveyance unit 18 disposed in the open/close cover 14. It will be noted that, when the open/close cover 14 is closed, the transfer rollers 36Y to 36K are configured to press against the image holding members 20Y to 20K with predetermined pressure, with the conveyor belt 34 sandwiched therebetween, and rotate following the travel of the conveyor belt 34.

The image forming apparatus 10 includes a two-sided printing function for printing on both sides of the recording paper P. Specifically, the image forming apparatus 10 includes the function of transferring toner images to one side of the recording paper P and fixing the toner images with the fixing device 38, switching back and conveying the recording paper P to a two-sided conveyance path K3 such that the front and back sides of the recording paper P become reversed, transferring and fixing toner images to the other side of the recording paper P, and ejecting the recording paper P.

Figure 8:
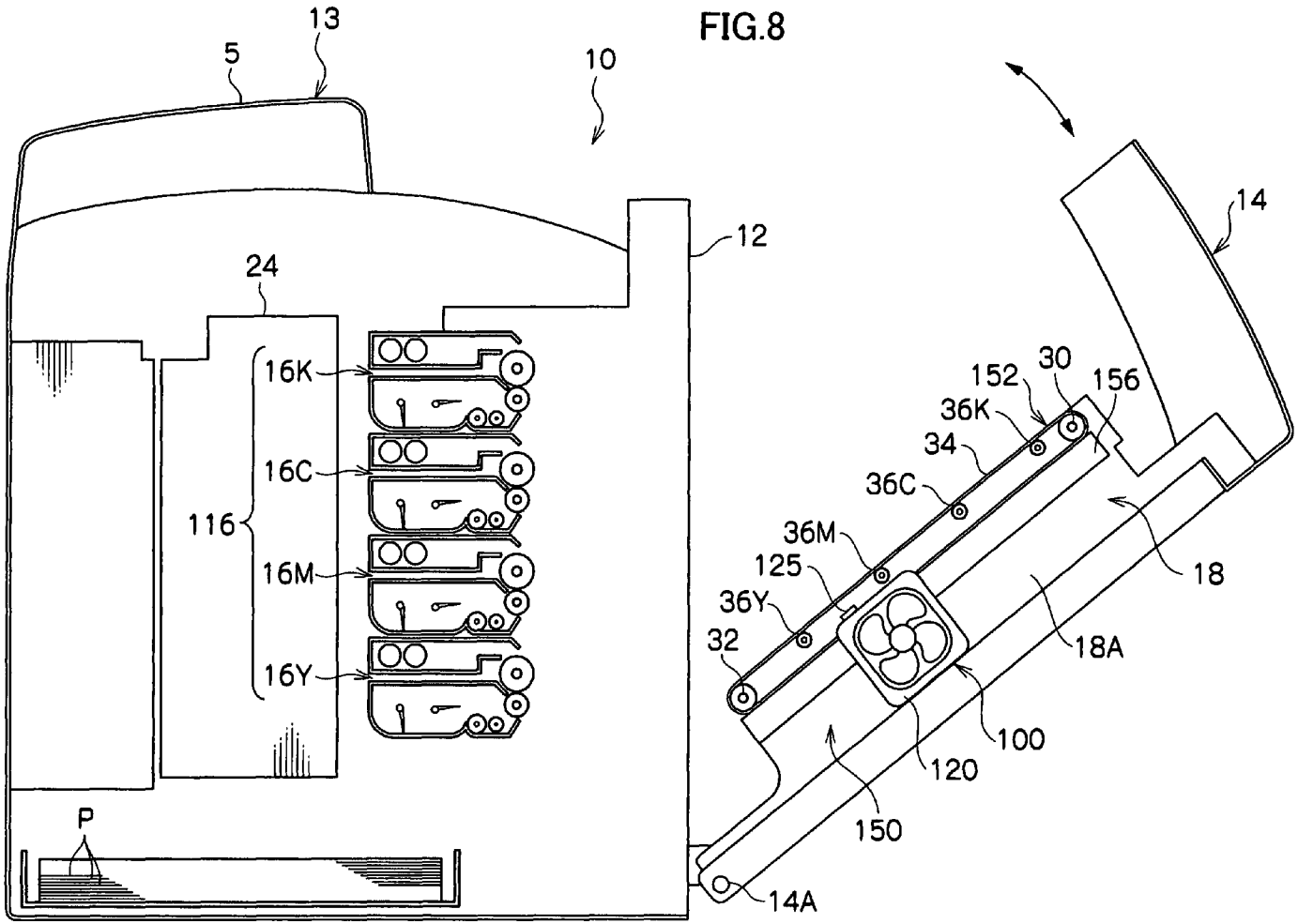
FIG. 8 is a side view showing a state where the open/close cover of the image forming apparatus pertaining to the exemplary embodiment of the present invention is open.
Figure 9:
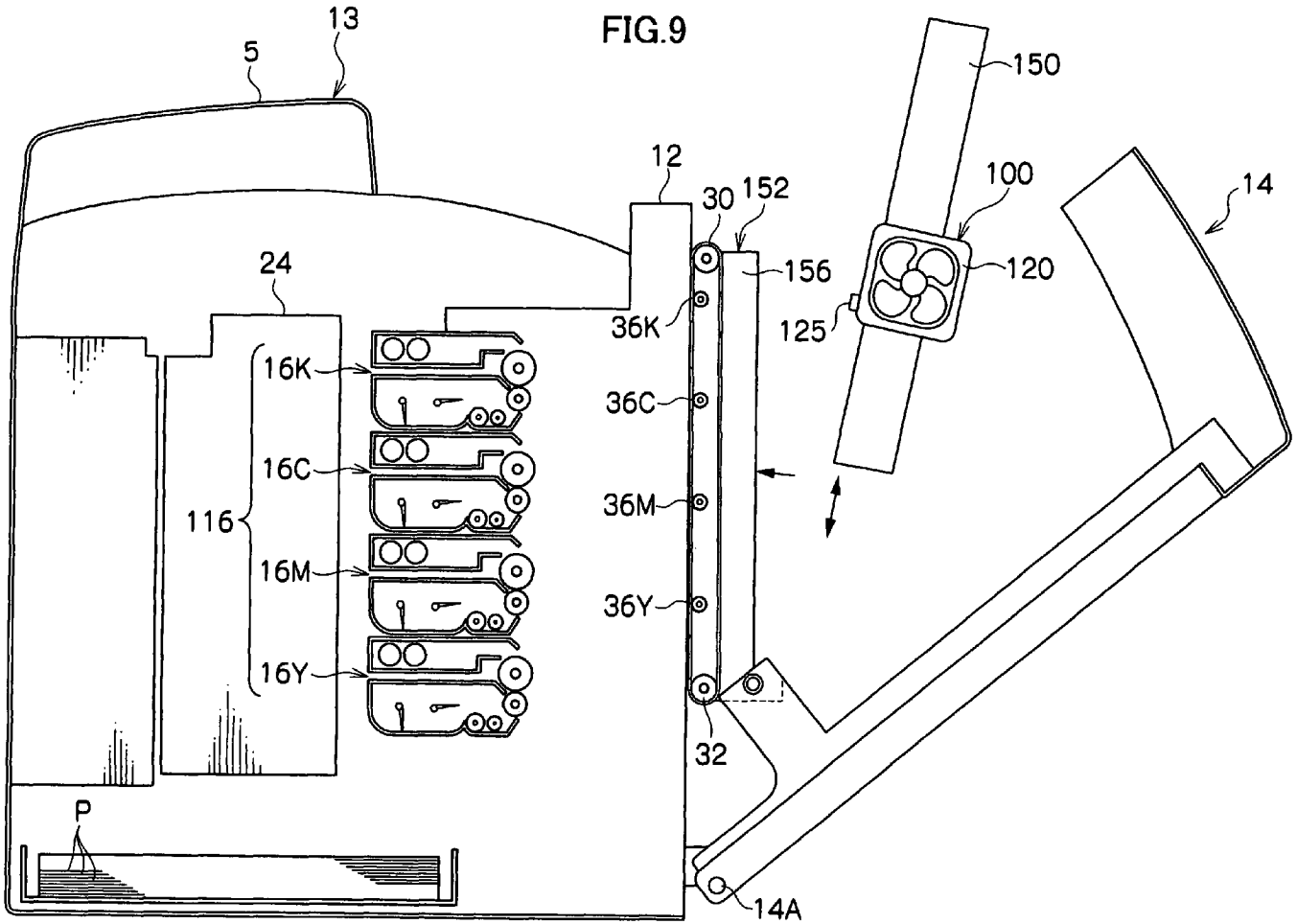
FIG. 9 is a view showing a state where a conveyance component is moved from the state in FIG. 8 and a two-sided printing unit is removed.
Figure 10:
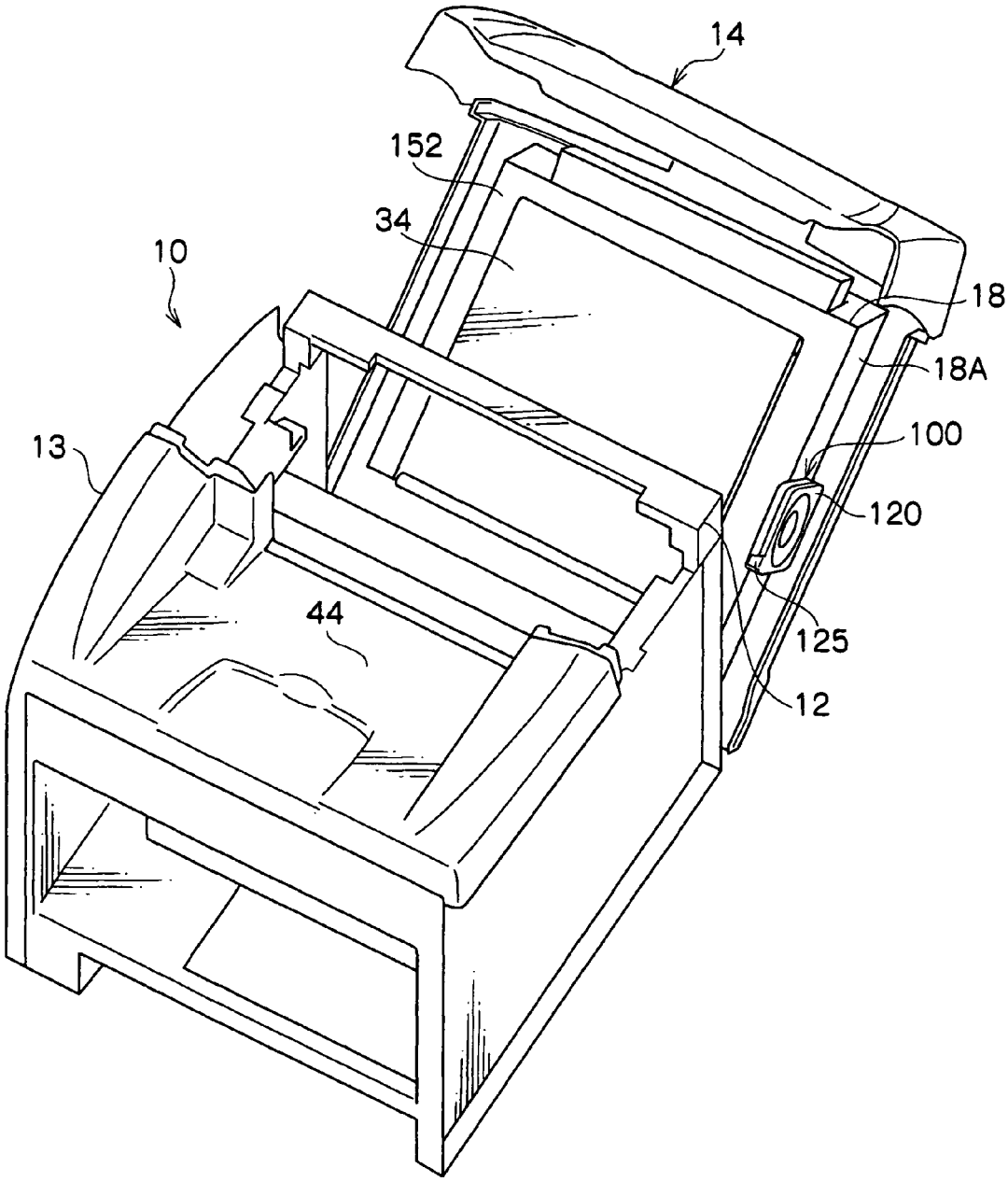
FIG. 10 is a perspective view where the state where the open/close cover of the image forming apparatus pertaining to the exemplary embodiment of the present invention is open is seen from the rear of the apparatus.
Figure 11:
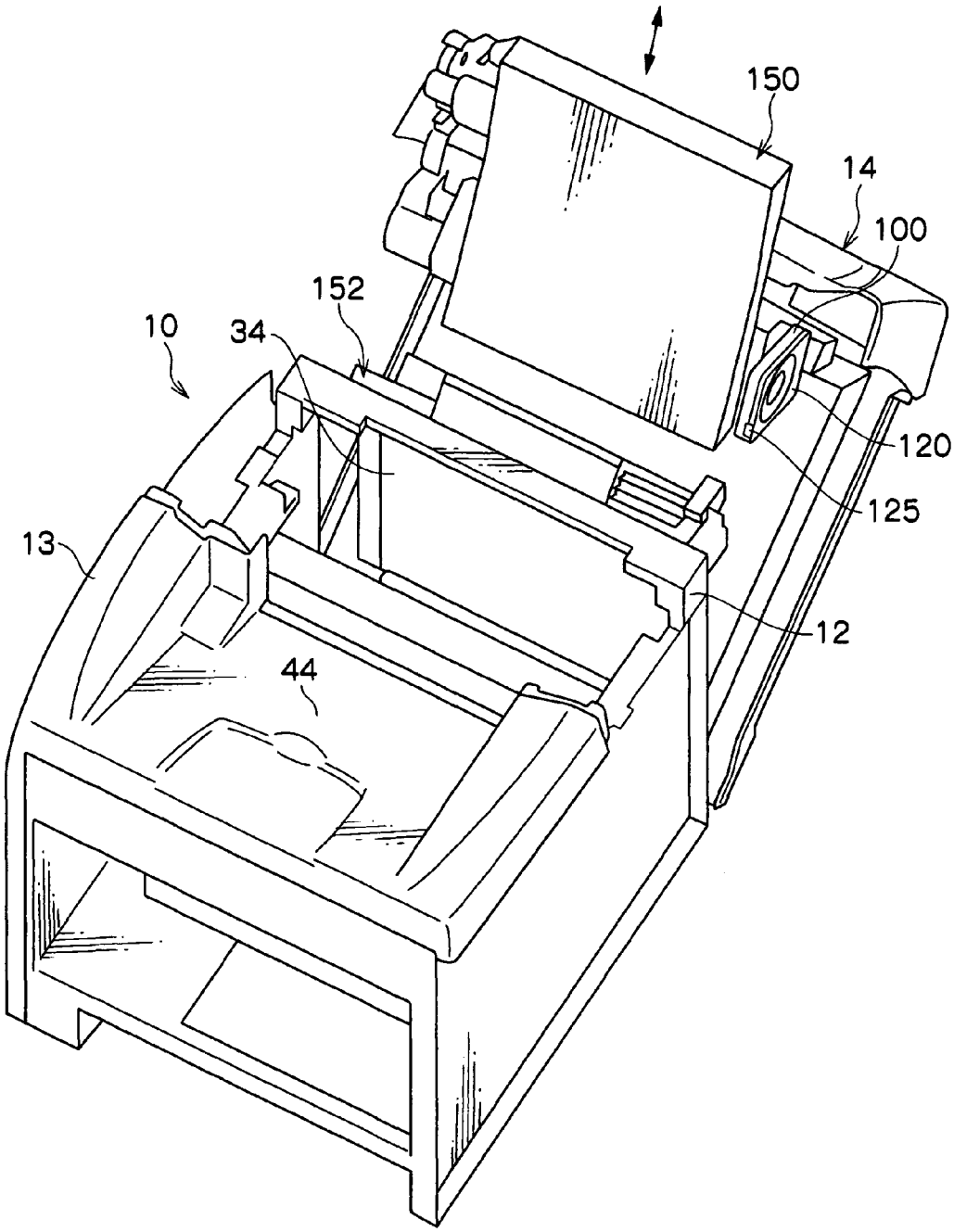
FIG. 11 is a view showing a state where the conveyance component is moved from the state in FIG. 10 and the two-sided printing unit is removed.

A two-sided printing unit 150 (see FIG. 9) that includes the two-sided conveyance path K3 is disposed in the conveyance unit 18. Further, as shown in FIG. 9 and FIG. 11, the two-sided printing unit 150 is configured such that it may be freely attached to and detached from the conveyance unit 18. The two-sided printing unit 150 may be attached and detached by rotating, toward the apparatus, just a conveyance component 152 including the conveyor belt 34 of the conveyance unit 18 as shown in FIG. 9 and FIG. 11 in a state where the open/close cover 14 has been opened as shown in FIG. 8 and FIG. 10.

The two-sided printing function is not standard but is added as a separate option, and the two-sided printing unit 150 is attached to the conveyance unit 18 just when the two-sided printing function is to be added as an option.

Figure 13:
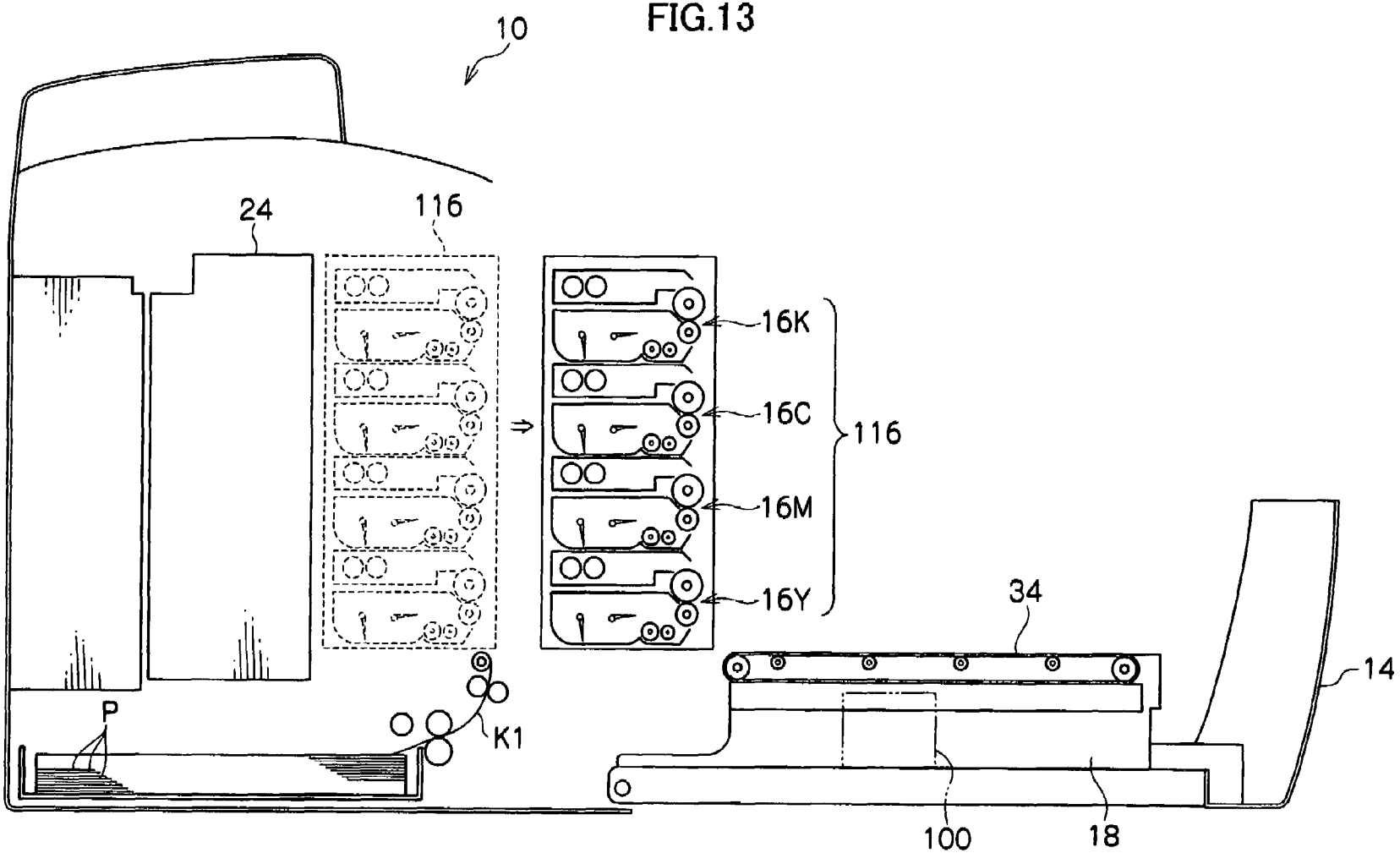
FIG. 13 is a side view showing a state where the open/close cover of the image forming apparatus pertaining to the exemplary embodiment of the present invention is opened and an image creating unit is attached and detached.

As shown in FIG. 13, the process units 16Y to 16K integrally configure an image creating unit 116. The image creating unit 116 may be attached and detached (replaced) by opening the open/close cover 14.

Figure 4:
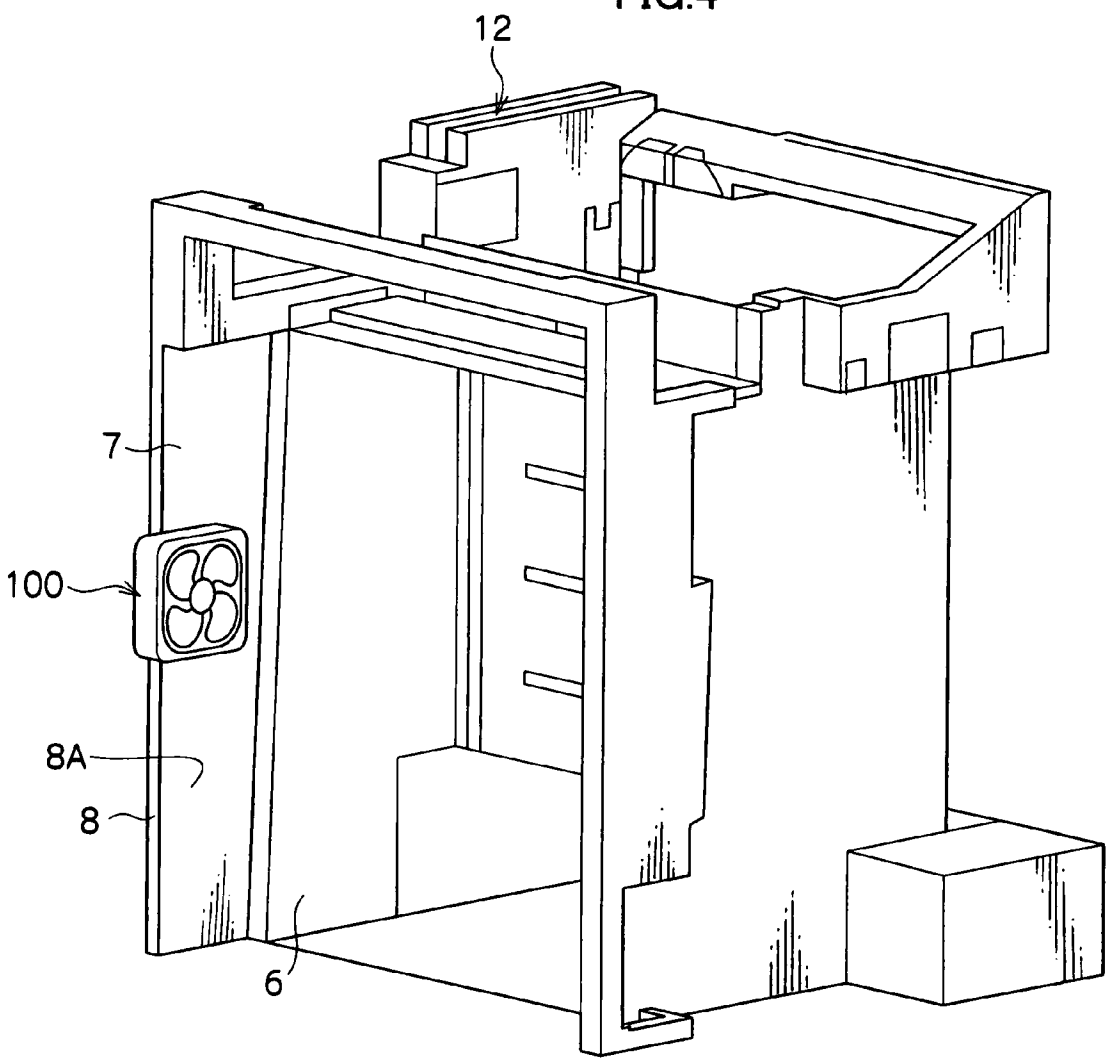
FIG. 4 is a perspective view showing a body frame.

Axial-direction end portions of the rotating shafts 21 of the photoreceptor drums 20 (the process units 16) are supported on a first side portion 6 of the body frame 12 shown in FIG. 4. A wide portion 7 whose width is wide is formed in an open portion of the front side of the body frame 12. It will be noted that a second side portion 8 present in the wide portion 7 is positioned further toward the outer side (the outer side with respect to the axial direction of the rotating shafts 21 of the photoreceptor drums 20) than the first side portion 6. Further, a suction fan 100 (described next) fits in the wide portion 7.

As shown in FIG. 2, FIG. 3, FIG. 8, FIG. 12, etc., the suction fan 100 is disposed in a side surface portion 18A at the outer side of the conveyance unit 18. Thus, the suction fan 100 moves integrally with the conveyance unit 18 in accompaniment with the opening and closing of the open/close cover 14. The open/close cover 14 is opened and closed by pivoting the open/close cover about a cover pivot 14A, as shown in FIG. 8. Moreover, as shown in FIG. 9 and FIG. 11, the suction fan 100 is disposed in the two-sided printing unit 150 and is attached and detached integrally with the two-sided printing unit 150.

Figure 7:
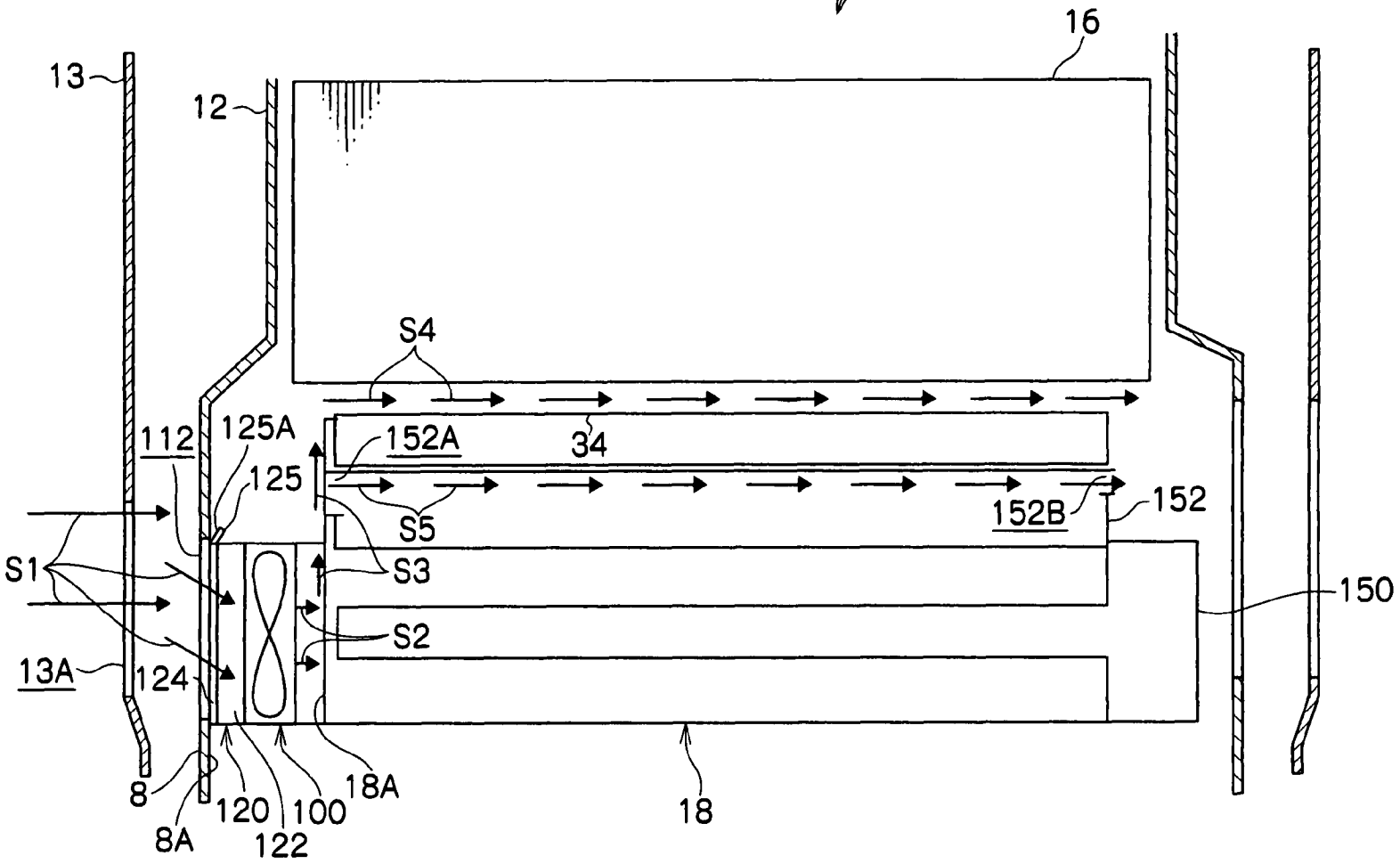
FIG. 7 is a descriptive diagram showing a transverse section of a front portion of the image forming apparatus and describing the flow of outside air.

As shown in FIG. 7, when the open/close cover 14 is closed, the suction fan 100 becomes disposed between the conveyance unit 18 and the second side portion 8 present in the wide portion 7 of the body frame 12 (see also FIG. 4).

As shown in FIG. 2 and FIG. 3, ventilation holes 112 are formed in the second side portion 8 of the wide portion 7 of the body frame 12 at positions corresponding to the suction fan 100 when the open/close cover 14 is closed.

Figure 5:
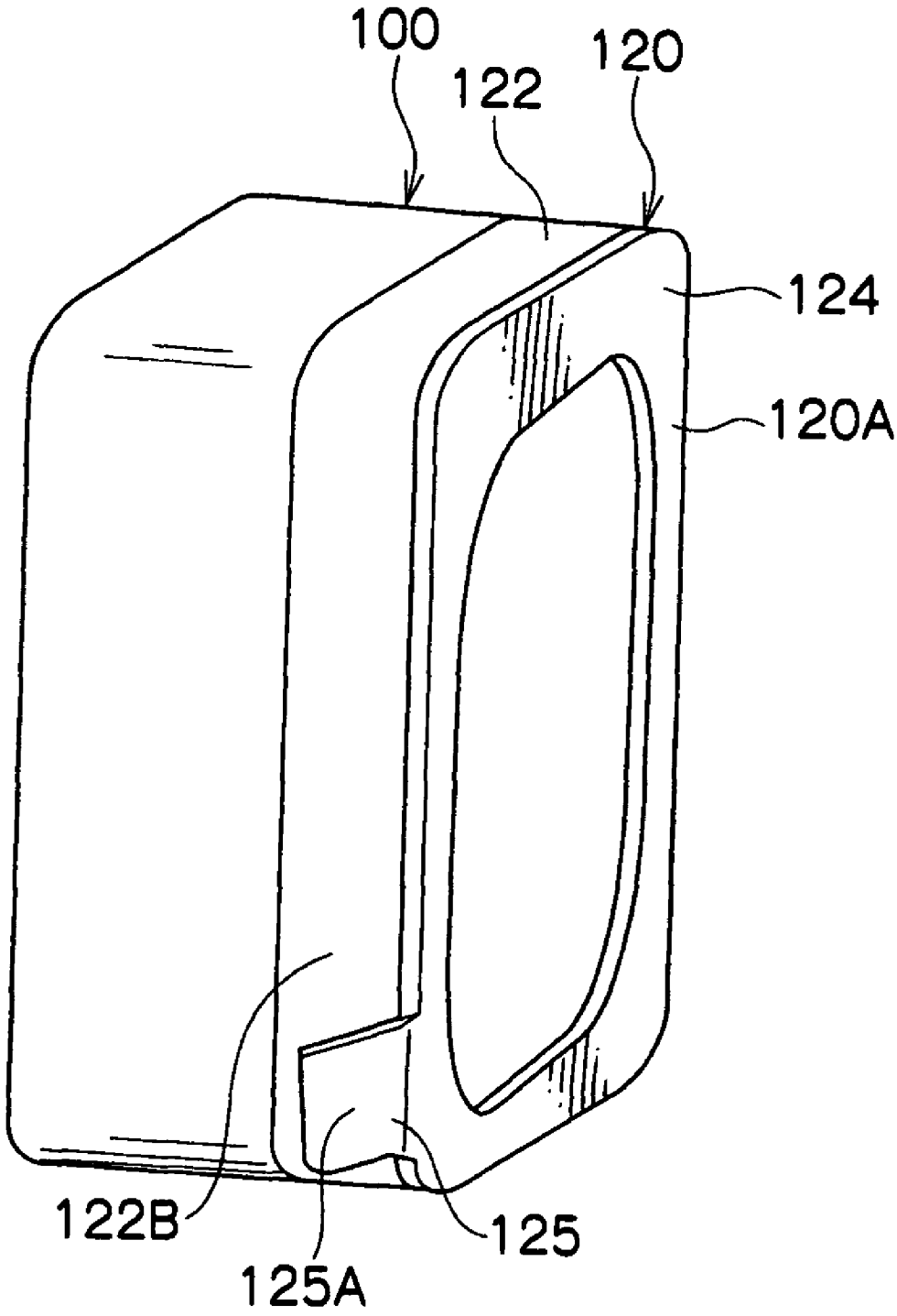
FIG. 5 is a perspective view of a suction fan disposed with a seal member.
Figure 12:
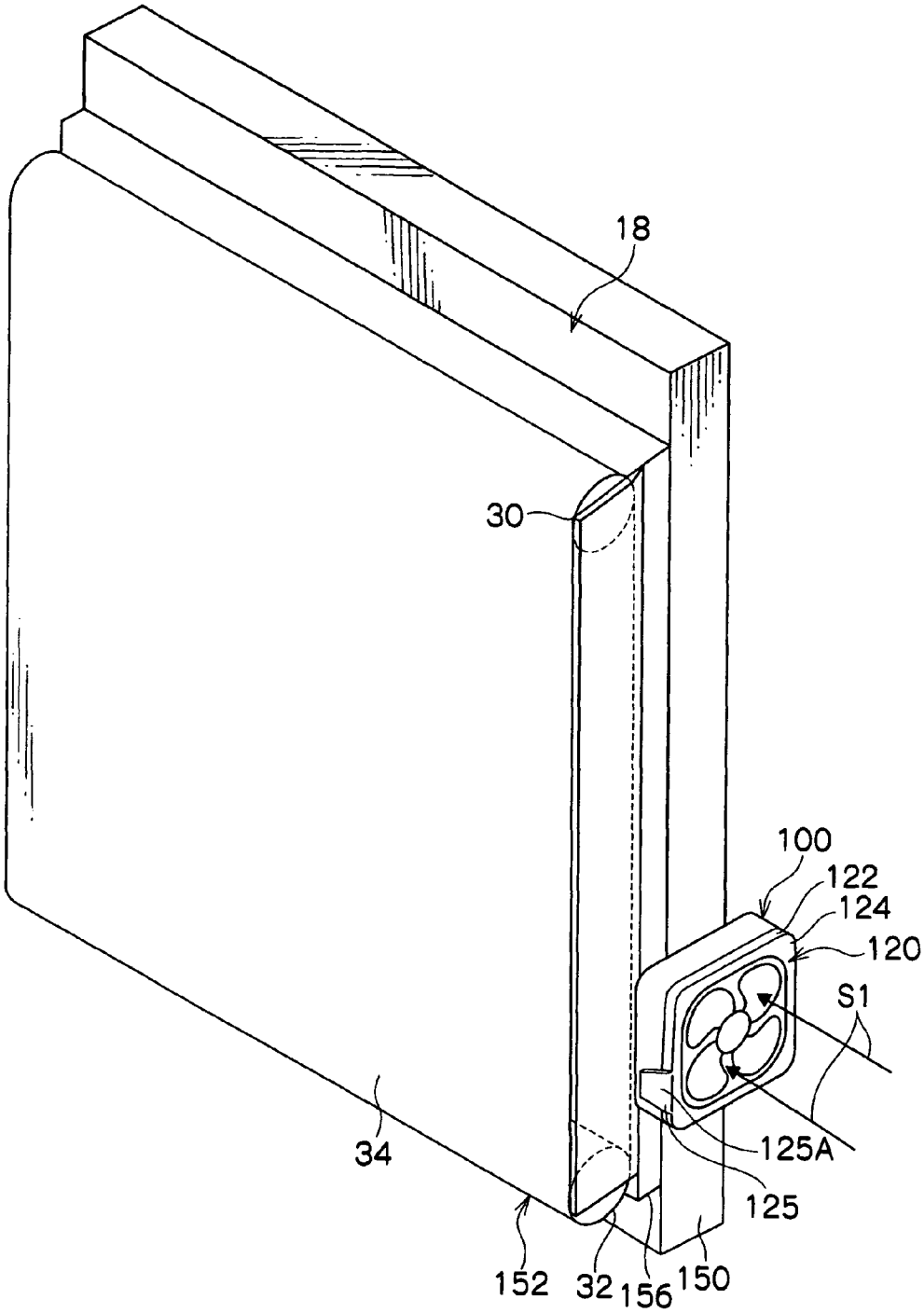
FIG. 12 is a perspective view showing the conveyance unit.

Further, as shown in FIG. 5 and FIG. 12, a seal member 120 is applied to the outer peripheral portion of the side surface portion of the suction fan 100. The seal member 120 is configured by an elastic member 122 such as a sponge and a PET sheet 124 that is applied to the outer side of the elastic member 122.

As shown in FIG. 7, when the open/close cover 14 is closed, the seal member 120 closely contacts the second side portion 8 of the body frame 12 and seals space between the ventilation holes 112 in the second side portion 8 and the suction fan 100 such that aeration is possible. Further, when the open/close cover 14 is opened and closed, the seal member 120 slidingly contacts the second side portion 8 of the body frame 12.

A guide portion 125 is disposed on a lower corner portion of the end portion of the seal member 120 at the side in the direction in which the open/close cover 14 closes. The guide portion 125 is formed as a result of part of the PET sheet 124 extending in the slide-contact direction (the direction when closing the open/close cover 14) and being bent inward (bent so as to cover an end surface 122B of the elastic member 122 at the side where the seal member 120 starts to slidingly contact the second side portion 8). This extending portion serves as an inclined surface 125A (see also FIG. 5 and FIG. 6).

When the open/close door 14 is open, the elastic member 122 is not compressed, so a side surface 120A of the seal member 120 (the PET sheet 124) is positioned further toward the outer side than an inner side surface 8A of the second side portion 8 (see FIG. 2, FIG. 4, and FIG. 7). Thus, if the guide portion 125 were not present, the end surface 122B of the elastic member 122 of the seal member 120 would contact the second side portion 8 of the body frame 12 when the open/close cover 14 is closed. However, after the inclined surface 125A of the guide portion 125 of the seal member 120 surface-contacts the second side portion 8 such that the seal member 120 (the elastic member 122) is compressed, the side surface 120A of the seal member 120 slidingly contacts the second side portion 8.

Next, the flow of air resulting from the suction fan 100 will be described.

Arrows S1 to S5 in FIG. 7 represent the flow of air resulting from the suction fan 100.

The suction fan 100 sends air in the axial direction of the rotating shafts 21 of the photoreceptor drums 20. Thus, as indicated by arrows S1, outside air enters through aeration openings 13A in the casing cover 13, and the suction fan 100 sucks in the outside air through the ventilation holes 112 in the body frame 12. The sucked-in outside air contacts the side surface portion 18A of the conveyance unit 18 as indicated by arrows S2. The air contacting the side surface portion 18A is guided inside toward the deep side of the apparatus as indicated by arrows S3. Thereafter, as indicated by arrows S4, the outside air flows between the conveyor belt 34 and the process units 16. That is, the outside air flows in the axial direction of the rotating shafts 21 (from left to right in the drawing) in the vicinities of the photoreceptor drums 20 and the development units 25 (the outside air flows in the axial direction of the rotating shafts 21 through diagonal line portion A in FIG. 1).

Further, as indicated by arrows S5, some of the outside air enters the conveyance unit 18 through an open portion 152A formed in one end portion of the conveyance component 152 of the conveyance unit 18 (the side surface portion 18A at the side where the suction fan 100 is disposed) and emerges from an open portion 152B in the other end portion. When the outside air passes through the conveyance component 152, it contacts the outer surface of the conveyor belt 34 (see FIG. 1). The flow of air is configured such that the outside air does not flow along the inner surface of the conveyor belt 34 (the surface that the transfer rollers 36 contact). It will be noted that the opening area of the open portion 152B in the other end portion of the conveyance component 152 is narrower than the opening area of the open portion 152A in the one end portion where the suction fan 100 is disposed.

Figure 6:
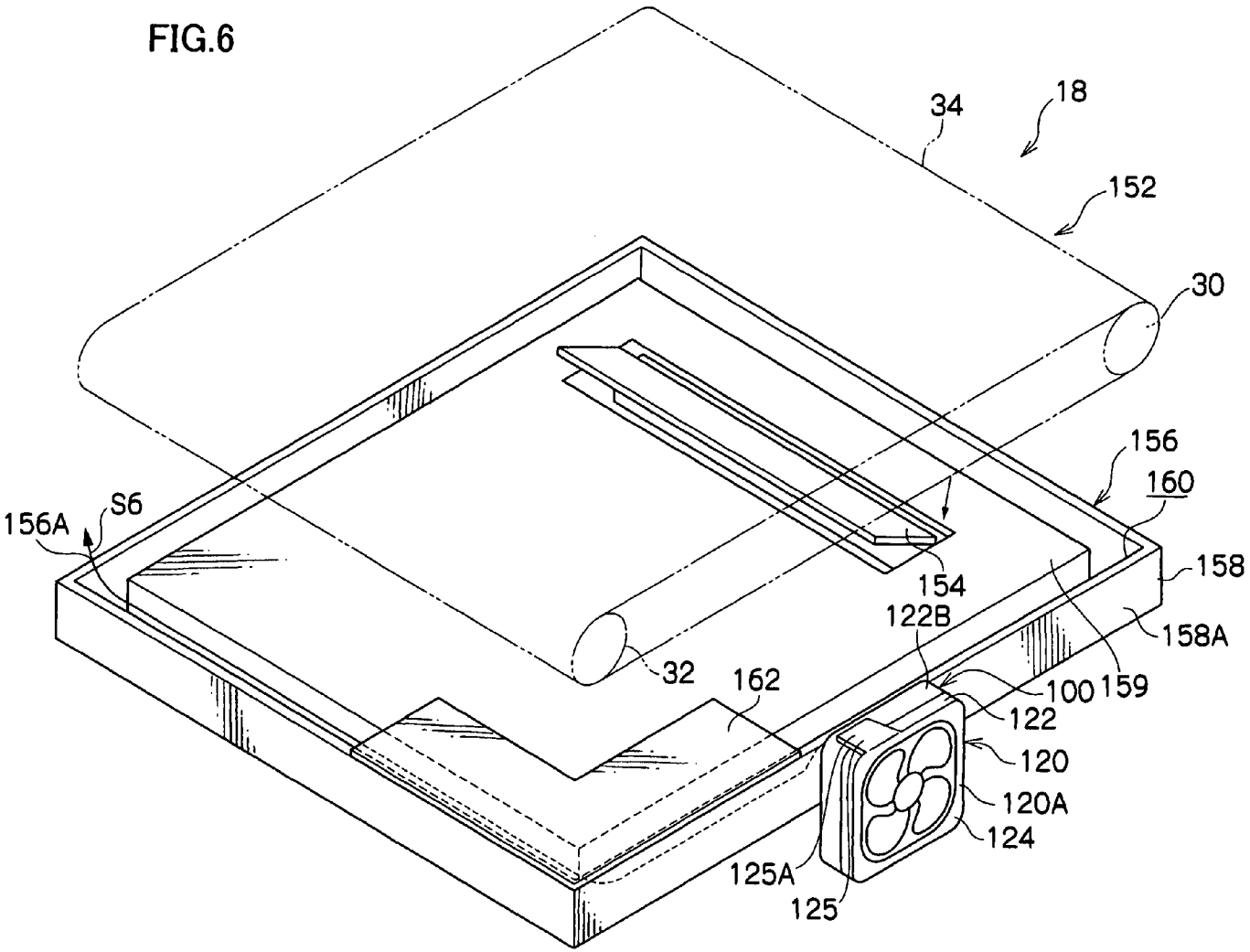
FIG. 6 is a perspective view showing a cleaning box of a conveyance unit.

As shown in FIG. 6, a cleaning blade 154 that cleans the conveyor belt 34 is disposed in the conveyance component 152 of the conveyance unit 18, and the conveyance component 152 is disposed with a cleaning box 156 that collects toner and dust removed by the cleaning blade 154. The cleaning box 156 is configured by ultrasonic-welding together a box body 159 and a back surface plate portion 158. A side wall 158A of the back surface plate portion 158 is disposed such that there is a gap between it and the periphery of the box body 159. Thus, a groove 160 is formed between the side wall 158A of the back surface plate portion 158 and the box body 159.

Moreover, an L-shaped lid member 162 covers the lower portion of the one end portion side where the suction fan 100 is disposed. Thus, as indicated by arrow S6 in FIG. 6, some of the outside air sent from the suction fan 100 passes through this groove 160 and flows toward the corner portion 156A of the end portion at the other side. The outside air flowing along this grove 160 (aeration path) is blown onto the other end portions of the lowermost photoreceptor drum 20Y and development unit 25Y.

Next, the action of the present exemplary embodiment will be described.

The increase in temperature in the vicinities of the photoreceptor drums 20 of the process units 16 and the development rollers 26 of the development units 25 is large. When the temperature in the vicinities of the photoreceptor drums 20 and the development units 25 rises, this results in deterioration of image quality. Thus, the outside air should flow to and cool these places.

The power supply units (not shown) and the drive mechanisms (not shown) comprising gears and the like for driving the photoreceptor drums 20 and the development rollers 26 are disposed at the outer side of the process units 16 in the axial direction of the rotating shafts 21 of the photoreceptor drums 20. Thus, when a suction fan is disposed on the outer side of the process units 16, the size of the apparatus becomes larger in its width direction. Further, the drive mechanisms and the power supply units become an obstruction and it is difficult for air to be allowed to flow in the axial direction of the rotating shafts 21.

In the present exemplary embodiment, the process units 16 are densely in order to make the entire apparatus compact. Thus, if a suction fan is disposed in the rear portion of the apparatus and outside air is sent in the direction orthogonal to the axial direction of the rotating shafts 21, that is, from the rear to the front, it is difficult for the outside air to be allowed to flow between the process units 16.

Thus, in the present exemplary embodiment, the suction fan 100 is disposed in the side surface portion 18A of the conveyance unit 18 so that the suction fan 100 may be disposed outside vicinities of the drive mechanisms and the power supply units may be avoided. It will be noted that because the belt member 34 of the conveyance unit 18 is driven just by the drive roller 30, there is a drive mechanism comprising a gear and the like just at the outer side in the vicinity of the drive roller 30, but there is sufficient space to dispose the suction fan 100 outside this vicinity. That is, even when the suction fan 100 is disposed in the side surface portion 18A of the conveyance unit 18, the size of the entire apparatus does not become larger.

Additionally, as indicated by arrows S1 to S4 in FIG. 7, the outside air taken in by the suction fan 100 is rectified after it contacts the side surface portion 18A of the conveyance unit 18, and flows in the axial direction of the rotating shafts 21 in the vicinities (diagonal line portion A in FIG. 1) of the photoreceptor drums 20 and the development rollers 26 of the development units 25. It will be noted that the cooling efficiency is good because the vicinities of the photoreceptor drums 20 and the development rollers 26 of the development units 25 that are places to be cooled and the suction fan 100 are not greatly distant from each other.

Further, the increase in temperature is greatest at the lowermost photoreceptor drum 20Y and development unit 25Y. The reason for this is thought to be because there is a clutch (not shown) and the like for the registration roller pair 49 at a position in this vicinity. Thus, as indicated by arrows S6 in FIG. 6, the outside air flowing along the groove 160 (airflow path) in the cleaning box 156 of the conveyance component 152 of the conveyance unit 18 is blown onto the other end portions of the lowermost photoreceptor drum 20Y and development unit 25Y, so that the places where the temperature increase is large may be pinpointed and effectively cooled.

Further, as indicated by arrows S5 in FIG. 7, some of the outside air enters the conveyance component 152 through the open portion 152A in the one end portion of the conveyance component 152 and emerges from the open portion 152B in the other end portion. When the outside air passes through the conveyance component 152 in this manner, the outside air contacts the outer side of the conveyor belt 34 and the conveyor belt 34 is cooled. Additionally, because the conveyor belt 34 is cooled, the photoreceptor drums 20 contacting the conveyor belt 34 are cooled.

It will be noted that the opening area of the open portion 152B in the other end portion is narrower than the opening area of the open portion 152A in the one end portion where the suction fan 100 is disposed. Thus, more outside air flows in the vicinities of the photoreceptor drums 20 and the development rollers 26 of the development units 26 indicated by arrows S4, without flowing through the conveyance component 152 more than necessary.

Further, as shown in FIG. 3, FIG. 8, etc., the suction fan 100 moves integrally with the conveyance unit 18 in accompaniment with the opening and closing of the open/close cover 14. Thus, the positional relationship between the suction fan 100 and the conveyance unit 18 does not become shifted as a result of opening and closing the open/close cover 14 (movement of the conveyance unit 18). Consequently, rectification of the outside air blown from the suction fan 100 such as indicated by arrows S1 to S5 in FIG. 7 and arrows S6 in FIG. 6 is accurately performed. That is, the state where the cooling efficiency is good is always maintained regardless of opening and closing the open/close cover 14 (movement of the conveyance unit 18).

Further, as shown in FIG. 7, when the open/close cover 14 is closed, the seal member 120 tightly contacts the second side portion 8 of the body frame 12 and seals space between the suction fan 100 and the ventilation holes 112 in the second side portion 8 such that aeration is possible. Thus, the outside air may be efficiently sucked through the ventilation holes 112.

It will be noted that the side surface 120A of the seal member 120 slidingly contacts the second side portion 8 of the body frame 12 after the inclined surface 125A of the guide portion 125 of the seal member 120 surface-contacts the second side portion 8 when the open/close cover 14 is opened and closed, so the end surface 122B of the elastic member 122 of the seal member 120 does not contact and come off when the open/close member 14 is opened and closed.

The image forming apparatus 10 of the present exemplary embodiment includes as an option the two-sided printing function for printing on both sides of the recording paper P. In the case of two-sided printing, when a toner image has been fixed by the fixing device 38 on one side of the recording paper P, the recording paper P is conveyed to the two-sided conveyance path K3. When a toner image is fixed on one side of the recording paper P, the temperature of the recording paper P is high. For this reason, when a toner image is transferred to the other side of the recording paper P, the recording paper P does not take away heat from the photoreceptor drums 20 but rather causes the temperatures of the photoreceptor drums 20 to rise. For this reason, the temperature rise is greatest during two-sided printing.

Additionally, in the image forming apparatus 10 of the present exemplary embodiment, an increase in temperature in the vicinities of the photoreceptor drums 20 and the development rollers 26 of the development units 25 becomes a problem during two-sided printing, but does not become that much of a problem in other cases. That is, the suction fan 100 is necessary just when the image forming apparatus 10 is equipped with the two-sided printing function as an option. Consequently, as shown in FIG. 9 and FIG. 11, the suction fan 100 is configured such that it may be attached and detached integrally with the two-sided printing unit 150. That is, the suction fan 100 is disposed just when an increase in temperature becomes a problem. Thus, the cost of the entire apparatus may be kept under control.

Further, as shown in FIG. 4, the body frame 12 is disposed with the wide portion 7 (the opening of the body frame 12 is enlarged). Thus, the ease with which the image creating unit 116 may be attached and detached is extremely good (see FIG. 13). Moreover, the distance between the suction fan 100 and the side surface portion 18A of the conveyance unit 18 is wide. Thus, it is easy to perform rectification of the outside air blown from the suction fan 100.

The present invention is not limited to the above-described exemplary embodiment.

For example, although the first side portion 6 and the second side portion 8 that support the process units 16 (the photoreceptor drums 20) are disposed on the same body frame 12, the present invention is not limited to this. For example, when the body frame 12 is not disposed with the wide portion 7, the seal member 120 of the suction fan 100 may be configured to directly tightly contact the casing cover 13 of FIG. 7.

Further, for example, although the suction fan 100 is configured to be attached and detached integrally with the two-sided printing unit 150, the present invention is not limited to this. The conveyance component 152 of the conveyance unit 118 may also be configured to be disposed with the suction fan 100.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to are suited to the particular use contemplated. It is intended that the scope of the invention be defined by the following claims and their equivalents.

What is claimed is:

1. An image forming apparatus comprising:

a plurality of image holding members that hold toner images;

a belt unit that comprises a belt member disposed facing the plurality of image holding members;

an apparatus side portion that is disposed on an outer side of the belt unit in an axial direction of rotating shafts of the plurality of image holding members; and a fan unit that is disposed between the apparatus side portion and the belt unit and aerates end portions of the belt unit in the axial direction of the rotating shafts.

2. The image forming apparatus of claim 1, wherein the belt member comprises a conveyor belt that conveys a recording medium to which the toner images are transferred.

3. The image forming apparatus of claim 1, wherein the belt unit moves in conjunction with an open/close member rotatably supported on an apparatus body comprising the apparatus side portion, and the fan unit moves integrally with the belt unit.

4. The image forming apparatus of claim 3, wherein the apparatus side portion has a ventilation hole at a position corresponding to the fan unit, and the image forming apparatus further comprises a seal member that is disposed in the fan unit, is capable of slidingly contacting the apparatus side portion, and seals space between the apparatus side portion and the fan unit such that aeration is possible through the ventilation hole.

5. The image forming apparatus of claim 4, wherein the seal member comprises, at a place where the seal member starts slidingly contacting the apparatus side portion, a guide portion that guides, to the apparatus side portion, a slide-contact surface that slidingly contacts the apparatus side portion.

6. The image forming apparatus of claim 5, wherein the guide portion comprises an inclined surface that extends in a slide-contact direction from the slide-contact surface and is inclined toward the fan unit.

7. The image forming apparatus of claim 1, wherein a two-sided printing unit, in which a conveyance path for two-sided printing is disposed along the belt member, is disposed in the belt unit such that the two-sided printing unit may be freely attached and detached, and the fan unit is attached and detached integrally with the two-sided printing unit.

8. The image forming apparatus of claim 1, wherein the apparatus side portion is positioned further toward the outer side than the end portions in the axial direction of the rotating shafts of the image holding members.

9. The image forming apparatus of claim 1, wherein a member disposed with the apparatus side portion is a member separate from a support portion that supports the image holding members.

10. The image forming apparatus of claim 1, wherein an opening area of an open portion at one side of the end portions is narrower than an opening area of an open portion at another side of the end portions in the axial direction of the rotating shafts where the fan unit is disposed.

11. The image forming apparatus of claim 1, wherein the belt unit comprises an aeration path that guides air sent by the fan unit to a predetermined site.

12. An image forming apparatus comprising:

a plurality of image holding members that hold toner images;

a belt unit that comprises a belt member disposed facing the plurality of image holding members;

a two-sided printing unit that is disposed in the belt unit such that the two-sided printing unit may be freely attached and detached and in which a conveyance path for two-sided printing is disposed along the belt member;

an apparatus side portion that is disposed on an outer side of the belt unit in an axial direction of rotating shafts of the plurality of image holding members; and a fan unit that is disposed in the two-sided printing unit so as to be disposed between the apparatus side portion and the belt unit and aerates end portions of the belt unit in the axial direction of the rotating shafts.

13. An image forming apparatus comprising:

a plurality of image holding members that hold toner images and are juxtaposed such that rotating shafts of the plurality of image holding members are parallel to a vertical direction;

a belt unit comprising a conveyor belt that is disposed facing the plurality of image holding members and conveys a recording medium to which the toner images are transferred;

an apparatus side portion that is disposed on an outer side of the plurality of image holding members and the belt unit in an axial direction of rotating shafts of the plural image holding members and has a ventilation hole; and a fan unit that is disposed between the apparatus side portion and the belt unit at a position corresponding to the ventilation hole and aerates end portions of the belt unit in the axial direction of the rotating shafts.

14. The image forming apparatus of claim 13, wherein the belt unit comprises an aeration path that guides air sent by the fan unit, and due to the aeration path, the air flows in the axial direction of the rotating shafts from one end portion of the apparatus side portion of the end portions of the belt unit to another end portion of the end portions along a surface of the conveyor belt that conveys the recording medium and the vicinity of the plurality of image holding members.

15. The image forming apparatus of claim 13, wherein the fan unit comprises a suction fan.

16. The image forming apparatus of claim 13, wherein the conveyor belt is wrapped around two rollers, and the fan unit is disposed at a position corresponding to between the two rollers.

17. The image forming apparatus of claim 13, further comprising an open/close member that is rotatably supported on a bottom portion of an apparatus body comprising the apparatus side portion, wherein the belt unit moves in conjunction with the open/close member, and the fan unit moves integrally with the belt unit.

18. The image forming apparatus of claim 17, wherein the fan unit comprises a seal member that seals space between the apparatus side portion and the fan unit, and the seal member comprises an elastic member and a guide portion that covers the apparatus side portion side of the elastic member, extends in a direction in which the open/close member closes, and is bent so as to cover the closing-direction side of the elastic member.

19. The image forming apparatus of claim 17, wherein the image forming apparatus further comprises a two-sided printing unit that is disposed in the belt unit such that the two-sided printing unit may be freely attached and detached and comprises a conveyance path for two-sided printing, and the fan unit is attached and detached integrally with the two-sided printing unit.

* * * * *